United States Patent [19]

Corkin et al.

[11] Patent Number: 4,885,927

[45] Date of Patent: Dec. 12, 1989

[54] METHOD AND APPARATUS FOR PRESS FORMING INTRICATE METALLIC SHAPES SUCH AS SPOOL VALVE ELEMENTS

[75] Inventors: William R. Corkin, Ypsilanti; Ram D. Bedi, Birmingham, both of Mich.

[73] Assignee: General Motors Corporation, Detroit, Mich.

[21] Appl. No.: 242,581

[22] Filed: Sep. 12, 1988

[51] Int. Cl.[4] ..... B21K 1/06

[52] U.S. Cl. ..... 72/342; 72/359

[58] Field of Search ..... 72/342, 357, 359, 700; 420/515, 514; 427/305; 204/49; 29/157.1

[56] References Cited

U.S. PATENT DOCUMENTS

| | | | |
|---|---|---|---|
| 3,785,811 | 1/1974 | Pelzel | 420/514 |
| 4,113,248 | 9/1978 | Yanagioka | 204/49 |
| 4,299,111 | 11/1981 | Fayal et al. | 72/342 |
| 4,317,355 | 3/1982 | Hatsuno et al. | 72/342 |
| 4,399,681 | 8/1983 | Hatsuno | 72/342 |

FOREIGN PATENT DOCUMENTS

| | | | |
|---|---|---|---|
| 1355502 | 6/1974 | United Kingdom | 72/700 |

*Primary Examiner*—Lowell A. Larson

*Attorney, Agent, or Firm*—Donald F. Scherer

[57] ABSTRACT

A process, apparatus and alloy for net forming intricate metallic shapes. A fixed die (30) is mounted in a forging press (20). The die (30) has a cavity (45) at least the proximal end (62) of which is open to receive a ram (55). The cavity (45) is contoured to the shape of the finished article to be forged therein, and a metallic slug (50) is receivable within the cavity (45). The ram (55) is driven into the proximal end (62) of the cavity (45) against the proximal end (63) of the slug (50) under selected pressure and temperature and for a selected period of time. The slug (55) is thereby forged into close conformity with the contours of the cavity (45), the formation of the slug (50) being accomplished first at the distal end (64) of the slug and thereafter being progressively initiated and completed toward and proximal end (63) thereof. The foregoing process has been found to be particularly suitable for net forming an zinc-aluminum alloy which may, if desired or required, be plated to provide the requisite hardness and sliding friction characteristic. One exemplary shape which can be net formed by this process is a close tolerance spool valve element (10).

8 Claims, 3 Drawing Sheets

METHOD AND APPARATUS FOR PRESS FORMING INTRICATE METALLIC SHAPES SUCH AS SPOOL VALVE ELEMENTS

TECHNICAL FIELD

The present invention relates generally to the forming of metals into intricate shapes. More particularly, the present invention relates to the net forming of intricate metallic shapes by press forming a metallic slug in a fixed die. Specifically, the present invention relates to press forming of intricate shapes such as a spool valve element with a plurality of disk-like lands projecting radially outwardly from a central shaft portion at longitudinally spaced intervals along the length of the shaft portion, and without incurring the drawbacks normally anticipated by employing such a manufacturing technique.

BACKGROUND OF THE INVENTION

The present invention relates, in part, to forming —i.e., the shaping of a metallic object by means of pressure and at least some heat. In general, press forming has an advantage over other ways of shaping metallic objects in that the grain pattern, and thus the strength, of the formed object may be rearranged in a direction appropriate to the anticipated stresses which are to be encountered by the finished object. A common method of press forming is known as forging.

In general there are two broad categories of forging—viz., cold forging and hot forging. The demarcation between cold and hot forging is delineated by the recrystallization temperature.

Cold forging is the plastic deformation of a metal at such temperature and rate that strain-hardening occurs. Cold forging crushes and disturbs the grain structure to such an extent that hardness is increased, and ductility decreased, in proportion to the amount of deformation. Cold forging is noted for providing smooth finished surfaces and considerable dimensional accuracy. These are desirable results, but it must be appreciated that as the process continues, sufficient internal stresses are imposed until at some point the metal will fracture. Hence, for complex shapes which require extensive displacement of the metal cold forging is not a viable option.

Hot forging, on the other hand, is the plastic deformation of metal at such a temperature and rate that strain-hardening does not occur. The lowest temperature for this process is the recrystallization temperature. Hot forging tends to break up large grain structure to produce a fine grain structure, with minimal porosity.

The particular means by which the deformation of the metal is accomplished provides a further classification of the forging processes. There are, for example, drop forging, press forging, upset forging and roll forging. The present invention is most closely related to a press forging operation, but one which provides uniquely improved upset forging results.

Press forging of metallic parts is accomplished by positioning a slug of preheated metal in a shaping die that is secured within a forging press. The steady pressure applied to the slug by the ram of the forging press forces the metal into the shape defined by the die. With the longitudinal axis of the slug being aligned with the longitudinal axis of the ram, movement of the metal along the axis of the slug is called "gathering," and movement of the metal radially of the direction along which the metal "gathers" is called "spreading," or "upsetting."

Over the years a number of parameters have been established to determine the propriety of press forming a particular configuration. For example, if the shape has a central shaft portion and a cylindrical disk portion that extends radially outwardly from the shaft portion, one rule is that the axial dimension of the disk portion should not be more than three times the diameter of the shaft portion. A second rule is that if the length of the shaft portion is greater than three times the diameter of the shaft portion, the diameter of the disk portion must not be more that one and one-half times the diameter of the shaft portion.

Of utmost significance to the present invention, however, is the fact that when utilizing a fixed die in a forging operation it has been fundamentally understood that any significant "spreading" must occur within fairly close proximity to either end of the slug, and when the forging operation is employed primarily to produce radial spreading, as when forming a head on a bolt, the process is categorized as upset forging.

In those situations where the slug must be upset at a significant distance from the end of the slug, a sliding die set has been thought to be required.

Sliding die sets generally include a stationary die which often constitutes the means by which to grip the slug, or work piece. An additional die is located in spaced relation to the fixed die, and the additional die is movable toward and away from the fixed die along a frame which serves as the die guide. The slug, which is gripped by the fixed die, passes through the sliding die so that as the ram pressure of the forging press applies pressure against the slug to upset the slug, the sliding die moves toward the fixed die to shape the material as it is upset from the slug. Such an arrangement has been found to work quite satisfactorily when the slug is to be upset at a considerable distance from the end of the slug.

It is also possible to provide a plurality of sliding dies in one die set, but when the slug is to be upset at three or more locations along the length thereof to form a plurality of disk-like projections which extend radially outwardly from the central shaft portion, too many problems have been encountered, or anticipated, for either press forging or upset forging to be considered as viable options by which to manufacture such shapes.

The problems heretofore encountered, or anticipated, when employing press forging or upset forging to fabricate such shapes can be readily understood when considering the manufacture of the commonly employed spool valve element.

A spool valve is a mechanical valve in which a uniquely configured valve element is reciprocated at predetermined increments axially within a machined valve chamber in order to effect selective communication between ports which open into the valve chamber at spaced locations along the axis of the spool valve chamber. The typical valve element of a spool valve has a central shaft portion with a plurality of lands which extend radially outwardly of the shaft portion at spaced intervals along the longitudinal axis of the shaft portion. The aforesaid valve element is received within the chamber for relative axial translation, and the radially outer surface of the lands effect a sealing engagement with the surface of the valve chamber. By selectively locating the ports in conjunction with selective axially spacing of the lands, the recesses between successive lands are utilized to effect selective communication between successive ports in response to the particular axial disposition of the valve element within the valve chamber, as is well known to the art.

Because of the plurality of radially extending, longitudinally spaced lands, press forging, or upset forging, of spool valve elements has heretofore been deemed inappropriate.

Spool valve elements normally have a plurality of sharp corners—i.e., most surfaces intersect at substantially right angles. Because of the sharp corners, it has heretofore been envisioned that the metal flowing into the lobes of a die employed to form the disk-like lands will tend to fold back on itself and form "coldshuts." In addition, when a plurality of the disk-like lands are to be formed it has been envisioned that as metal in the slug "gathers" to provide the metal required to "upset" into that lobe in which the land most remote from the forging ram is being formed, the metal in the slug would be forced to flow past the other, intermediate lobes into which the metal may already have begun to spread in order to complete the formation of the most remote land. The formation of each successive land has likewise been thought to require gathering flow past die lobes into which the metal had already begun to upset. Such flow would, at best, induce shear stresses at the juncture of the shaft and the land portions formed by the intermediate lobes. At worst, one or more of the lands being so formed in the intermediate lobes might be virtually severed from the central shaft portion.

For these reasons metallic spool valve elements have heretofore been machined from bar stock having a slightly greater outside diameter than required to finish the radially outermost periphery of the lands, or the valve element has been cast and then finish machined. If accurately cast, the part could be completed by a centerless grinder, but in either event the cost of fabricating a spool valve element has, of apparent necessity, been relatively expensive.

The desirability to minimize the production cost of spool valve elements can be readily appreciated when one considers that a considerable number of spool valves are effectively employed, for example, in conjunction with automatic vehicular transmissions. Providing a spool valve element with a plurality of successive lands, with the appropriate recesses therebetween, allows for simultaneous, or sequential, hydraulic actuation of the various clutch and band assemblies required to effect the drive selection in a planetary gear set. In fact, it is not uncommon to utilize as many as six, or eight, spool valves to effect drive selection for a vehicular transmission.

SUMMARY OF THE INVENTION

It is, therefore, a primary object of the present invention to provide an improved method for forging an intricate metallic shape to close dimensional tolerance—i.e., net forming—without incurring the drawbacks heretofore encountered, or anticipated, with either press forging or upset forging techniques.

It is a another object of the present invention to provide a single operation net forming method, as above, by which to press forge a metallic article having a plurality of radially extending projections spaced longitudinally along a central shaft portion without incorporating coldshuts or without inducing deleterious shear stresses.

It is a further object of the present invention to provide a net forming method, as above, which need not employ a sliding die set.

It is still another object of the present invention to provide a net forming method, as above, which will permit the press forging of an intricate metallic article such as a spool valve element without producing any significant scrap material.

It is a still further object of the present invention to provide an alloy having desirable flow properties under relatively moderate preheating such that it is particularly suited for net forming intricate metallic shapes by press forging techniques at significantly reduced work loads and thereby reduce the capital expenditures necessary to provide suitable forging presses.

It is yet another object of the present invention to net form an intricate metallic shape such as a spool valve element by press forging, as above, in such a way that the metallic shape need not be further machined and in such a way that the metallic shape can be readily plated to provide the desired hardness for its operating environment.

These and other objects of the invention, as well as the advantages thereof over existing and prior art forms, which will be apparent in view of the following detailed specification, are accomplished by means hereinafter described and claimed.

In general, a process embodying the concepts of the present invention utilizes a fixed die. The die, which is mounted in a forging press, has at least one cavity with opposed ends. At least one end of the cavity is open operatively to admit the ram of the forging press. The open end of the cavity through which the ram is received is proximal to the ram, and the opposite end of the cavity is located remotely from, or distal with respect to, the ram.

The cavity, contoured to the shape of the finished article to be formed therein, is preheated and a metallic slug is receivable within the cavity. The metallic slug may also be preheated.

The ram is driven into the proximal end of the cavity under selected pressure for a selected period of time, and the slug is thereby forged into close conformity with the contours of the cavity, the formation of the slug being accomplished at the distal end of the cavity and thereafter being progressively initiated and completed toward the proximal end thereof.

The subject process has been found to be particularly suitable for net forming an zinc-aluminum alloy into intricate shapes, such as are exemplified by a close tolerance spool valve element, which may be plated to provide the requisite hardness and sliding friction characteristic.

A method embodying the concepts of the present invention is described in conjunction with the manufacture of one exemplary article, and that description is deemed sufficient to effect a full disclosure of the subject invention. The article, and the apparatus by which the method is employed to form that article, are shown by way of example in the accompanying drawings and are described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
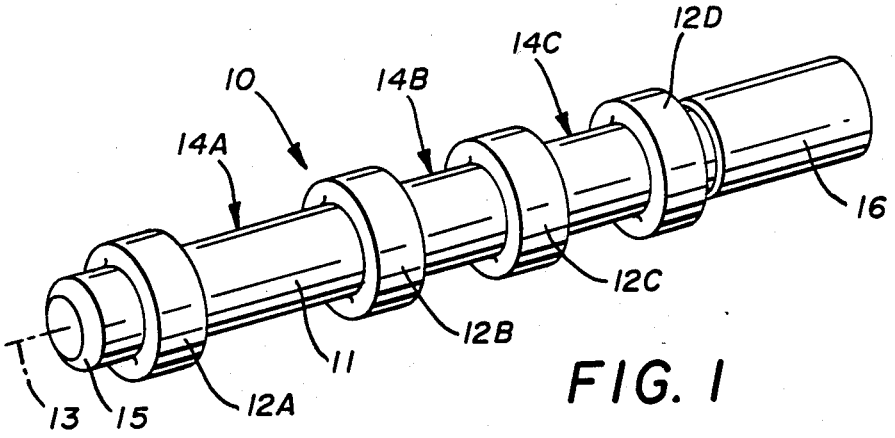
FIG. 1 is a perspective view of a spool valve element which incorporates a central shaft portion and a plurality of lands extending radially outwardly of the shaft portion at spaced intervals along the longitudinal axis of the central shaft portion.

A spool valve element which exemplifies an intricate metallic shape of the type which can be net formed by press forging according to the concepts of the present invention is indicated generally by the numeral 10 in FIG. 1 of the attached drawings. The spool valve element 10 is provided with a central shaft portion 11, and a plurality of disk-like lands 12 extend radially outwardly from the shaft portion 11. The particular spool valve element 10 depicted presents four lands 12A–12D which are longitudinally spaced along the axis 13 of the central shaft portion 11. As such, the four lands 12A–12D define three recesses 14A–14C by which communication between successive ports (not shown) in a spool valve housing (also not shown), is selectively determined. The valve element 10 typically presents a reaction surface 15 at one end of the shaft portion 11 which is generally provided to engage a biasing means (not shown) to urge the valve element 10 in one direction. Likewise, the valve element 10 typically presents an actuating tang 16 at the other end of the shaft portion 11 which is adapted to be operatively engaged by means to effect selective axial translation of the valve element 10 against any force applied by the biasing means which may engage the reaction surface 15.

Figure 2:
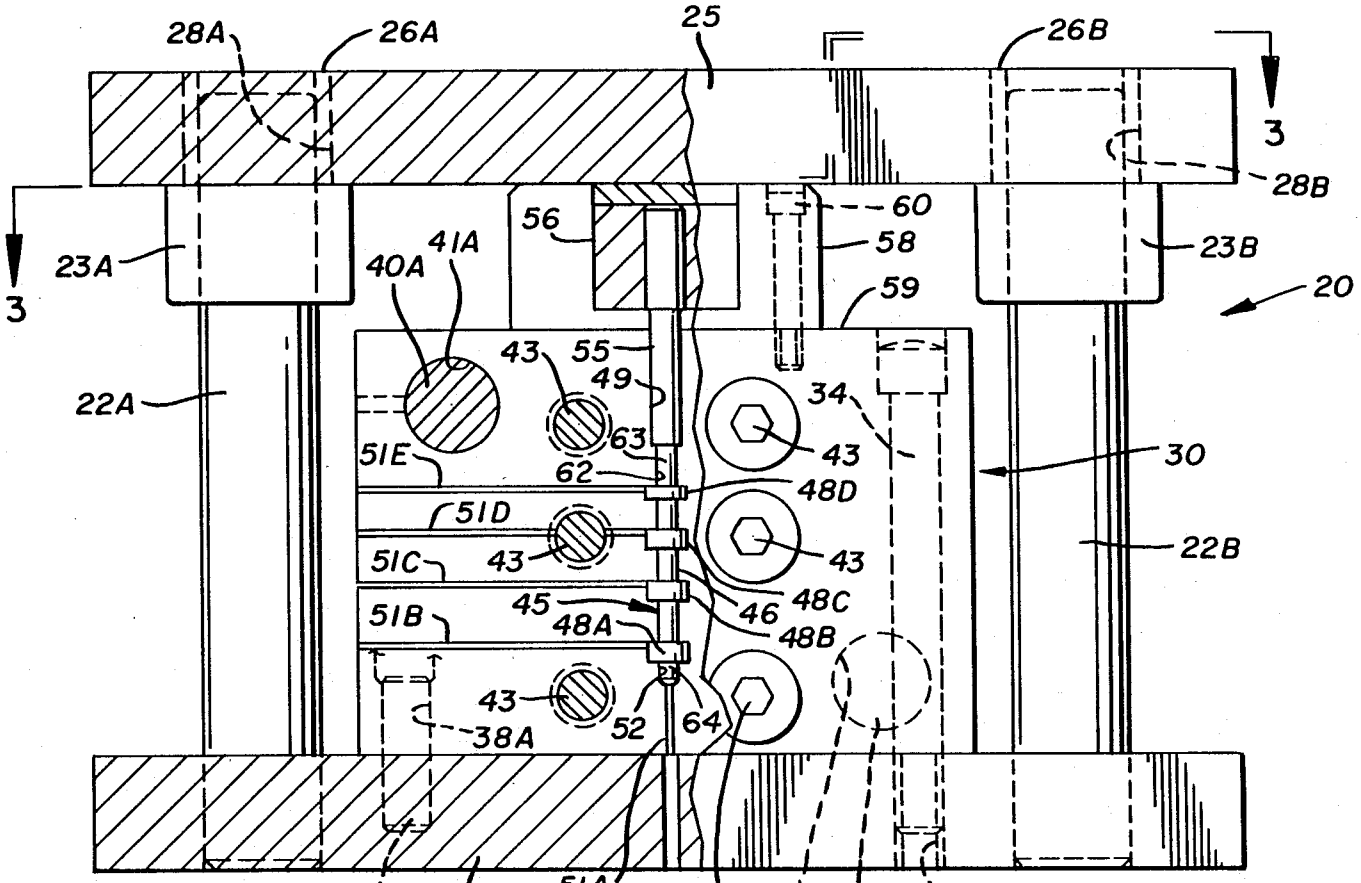
FIG. 2 is a side elevation, partly in section, of a fixed die that is mounted within a forging press, said view being taken substantially along line 2-2 of FIG. 3 and depicting the ram fully inserted within the cavity of the die.
Figure 3:
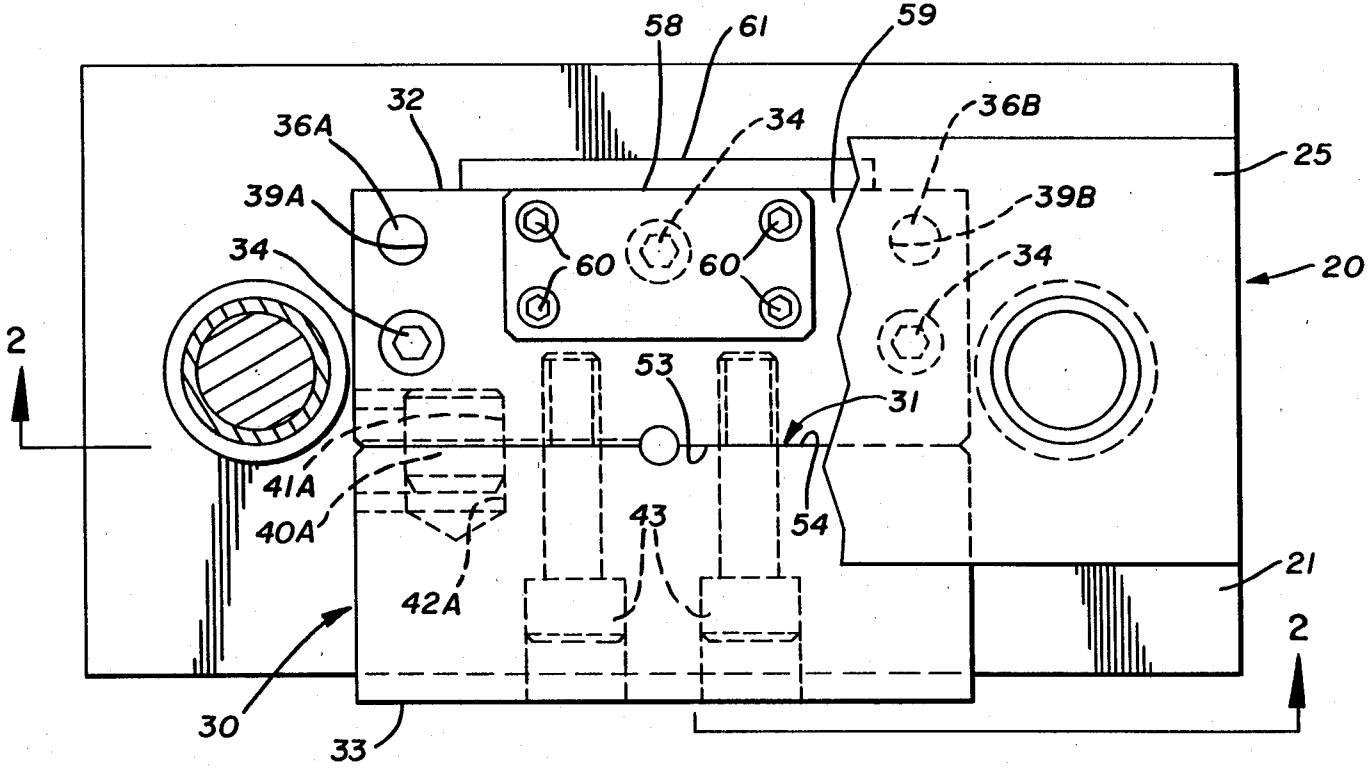
FIG. 3, is a top plan view of the structure depicted in FIG. 2 with the punch plate being partially broken away to provide a partial top plan of the fixed die, said view being taken substantially along line 3—3 of FIG. 2.

The aforesaid spool valve element 10 can be formed according to the concepts of the present invention in a press forge, the appropriate portions of which that are required for a full disclosure of the present invention being depicted in FIGS. 2 and 3 and being designated by the numeral 20. The press forge 20 has a base plate 21 in which a pair of laterally spaced, vertically oriented, guide posts 22A and 22B are anchored. A pair of collar bushings 23A and 23B are slidably received on the guide posts 22A and 22B, respectively, and a ram plate 25 is secured to the collar bushings 23A and 23B. As shown, the connecting ends 26A and 26B of the collar bushings 23A and 23B, respectively, may be secured within corresponding bores 28A and 28B in the ram plate 25.

A fixed die, indicated generally by the numeral 30, is secured to, and is supported from, the base plate 21. As best represented in FIG. 3, the die 30 has a vertically oriented parting plane 31 which separates the anchored block 32 of the die 30 from the removable block 33. The anchored block 32 may be secured to the base plate 21 by a plurality of machine bolts 34 which extend vertically through the anchored block 32 to be threadably received within appropriate bores 35 in the base plate 21. To assure that the anchored block 32 is accurately disposed relative to the base plate 21 a pair of aligning dowel pins 36A and 36B may extend from their respective aligning bores 38 (only bore 38A is depicted) in the base plate 21 into the corresponding aligning bores 39A and 39B in the anchored block 32 of the die 30.

With the anchored block 32 of the die 30 thus secured to the base plate 21, the removable block 33 is, in turn, secured to the anchored block 32. Specifically, accurate alignment of the removable block 33 relative to the anchored block 32 may be achieved by a second pair of aligning dowel pins 40A and 40B which extend from their respective aligning bores 41 (only bore 41A is depicted) in the anchored block 32 of the die 30 into the corresponding aligning bores 42A and 42B in the removable block 33 of the die 30. With the die blocks 32 and 33 thus accurately aligned with each other, a plurality of machine bolts 43 demountably secure the removable block 33 to the anchored block 32.

A cavity 45 is provided in the die 30. To facilitate removal of the article formed in the cavity 45, the cavity 45 is recessed partially into the anchored block 32 and partially into the removable block 33 so that the symmetrical parting line of the cavity 45 coincides with the parting plane 31 which separates the blocks 32 and 33 of the die 30. The cavity 45 has a cylindrical central portion 46 to form the central shaft portion 11 of the spool valve element 10 and a plurality of radially extending lobes 48 which are spaced longitudinally along the cylindrical central portion 46 of the cavity 45 to form the lands 12. To press form the exemplary intricate shape represented by the spool valve element 10 the cavity 45 would require four lobes 48A–48D to form the corresponding lands 12A–12D.

Figure 4:
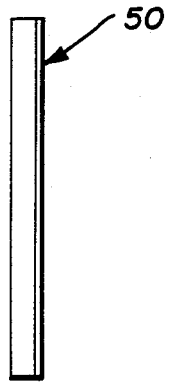
FIGS. 4, through 9—which appear on the same sheet of drawings as FIG. 1—comprise a sequential series of side elevational views of a metallic slug that is being net formed according to the method of the present invention, and in the apparatus depicted in FIGS. 2 and 3, said FIGS. 4–9 depicting the progressive stages of the net forming of the metal from a cylindrical slug to a finished, intricate shape, as exemplified by a spool valve element.

The cylindrical central portion 46 of the cavity 45 has an extension 49 to receive the excess length of the slug 50 (as depicted in FIG. 4) which is gathered to accommodate the volume of the metal which upsets from the cylindrical slug 50 to fill the lobes 48 as the lands 12 are formed therein, as will be hereinafter more fully explained.

A plurality of vents 51 may be provided to relieve any air pockets which might otherwise form to prevent accurate, full surface contact between the metal and the cavity 45 as the metal upsets from the slug 50 to conform with the contours of the cavity 45 in the process of net forming the intricate shaped spool valve element 10. Vent 51A is provided to relieve air from the distal end 52 of the central portion 46. Vents 51B through 51E are provided to relieve air that might gather in the lobes 48A through 48D, respectively, to prevent full surface contact between the metal as the slug 50 upsets to from the slug 50 into the lobes 48 to form the lands 12. Such vents 51 may, as shown, be conveniently formed by scoring the anchored and/or the removable blocks 32 and 33 of the die 30 along the engaging surface 53 and 54, respectively, which form the parting plane 31 of the die 30.

A ram 55 is secured in tool retainer 56 that is, in turn, secured to the ram plate 25. As the ram plate 25 is reciprocated along the guide posts 22 the ram 55 is driven into, along and then withdrawn from the extension 49 of the cavity 45. A stop block 58 may be secured to the anchored block 32 to determine the maximum travel of the ram 55 into the extension 49. As depicted, the stop block 58 may be secured to the upper surface 59 of the anchored block 32, as by a plurality of machine bolts 60.

The press 20, in conjunction with the die 30, may be employed to produce an intricate metallic shape, such as a spool valve element 10, according to the hereinafter described process.

A suitable cylindrical slug 50, such as is depicted in FIG. 4, is provided, and for the example of a spool valve element 10 which will be employed in the environment of a vehicular transmission that is subjected to elevated temperatures, it is highly desirable that the metal from which the valve element 10 is formed have a coefficient of thermal expansion that is compatible with the material within which the valve chamber is formed. Inasmuch as aluminum, or alloys thereof, are widely employed for transmission housings within which the spool valve chambers are machined, a material which has been found to be particularly suitable for net forming and which has an appropriate coefficient of thermal expansion is an zinc-aluminum alloy, and particularly an alloy having a range of from approximately 75 percent to approximately 78 percent zinc in combination with approximately 25 percent to approximately 22 percent aluminum, and including a trace of copper—on the order of approximately 0.2 percent.

A cylindrical slug 50, as depicted in FIG. 4, which may be formed from the aforesaid alloy is insertably received within the cavity 45. The outside diameter of the slug 50 is preferably such that the slug 50 may be readily inserted into the cylindrical center portion 46 of the die 30 and drop easily to the distal end 52 of the cavity 45. The slug 50 may be preheated to the desired temperature, and the die 30 is itself preferably heated to a temperature which will maintain the slug 50 at the optimum temperature for net forming the particular metal being forged. For example, the die 30 may be heated by incorporating suitable heating elements within, or on the surface of, the die blocks or by employing some form of radiant, or inductive, heating. The heating of die blocks is well known to the art, and as such representative heating means in the form of electric heating pads 61 are depicted as being secured to the blocks 32 and 33 of the die 30.

To achieve the desired, intricate, net forming of a metallic slug 50 by hot forging, and yet to assure the minimal temperature of recrystallization so that close dimensional accuracy can be achieved, it has been found to be highly desirable to employ a eutectic alloy.

In any alloy system there is generally at least one composition at which the alloy has the lowest possible melting point. That composition is a eutectic composition for the particular alloy system. More than one eutectic composition may occur within a given alloy system, but the aforesaid zinc-aluminum alloy composition is a eutectic alloy, and as such the temperature of crystallization may well be as low as 480 degrees F. (248.8 degrees C.). Within the compositional range of zinc to aluminum set forth, maintaining the cavity 45 of the die 30 and therefore the slug 50 within a temperature range of from about 480 degrees F. (248.8 degrees C.) to about 600 degrees F. (315.5 degrees C.) will assure that the eutectic alloy is above the recrystallization temperature and thereby assure the plastic flow characteristics desired for the slug 50 to conform with the contours of the cavity 45 when subject to a modest ram pressure for a relatively short period of time. In addition, by forging the eutectic alloy at approximately the temperature of recrystallization the grain refinement achieved by hot forging the alloy will be retained without the normal coarsening of the grain so often evident after hot forging metals.

With the temperature of the slug 50 properly maintained the forging press 20 is then actuated to drive the ram 55 into the proximal end 62 of the cavity 45—i.e., the proximal end of the extension 49—and against the proximal end 63 of the slug 50. The ram 55 applies pressure in the range of from about 8,000 pounds per square inch (562.4 kilograms per square centimeter) to about 14,000 pounds per square inch (984.2 kilograms per square centimeter) for a period of time from about one half (½) a minute to approximately two (2) minutes.

Under the aforesaid conditions of time, pressure and temperature a slug 50 comprised of an zinc-aluminum alloy having the composition hereinbefore previously stated will gather toward the distal end 64 of the slug 50 and will gather to form that portion of the central shaft portion 11 which presents the reaction surface 15 at the distal end 64 of the slug 50 and then upset to bring the slug 50 into radial conformity with the central portion 46 of the cavity 45 between the distal end 64 of the slug 50 and lobe 48A.

Figure 5:
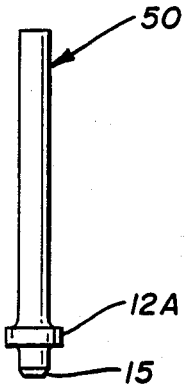

Sequentially thereafter the metal of the slug 50 will upset into lobe 48A to form the land 14A. At this point in the net forming process embodying the concepts of the present invention the slug 50 will have attained the configuration depicted in FIG. 5.

Figure 6:
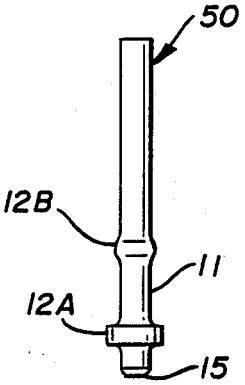

The continued maintenance of the conditions of temperature and pressure appropriate to the metal constituting the slug 50 will cause the metal of the slug 50 to continue to gather, as required, and upset to bring the slug 50 into conformity with the central portion 46 of the cavity 45 between lobes 48A and 48B and only thereafter to begin to upset into the lobe 48B, as depicted in FIG. 6.

Figure 7:
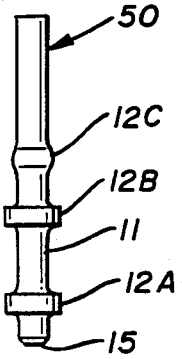
Figure 8:
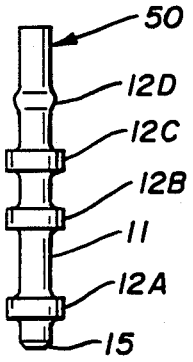
Figure 9:
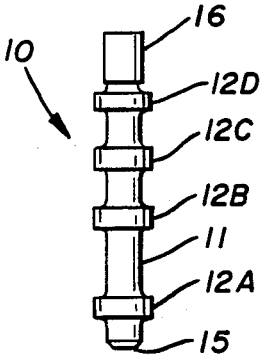

The aforesaid process continues progressively to form land 12B in lobe 48B and thereafter sequentially to form the central shaft portion 11 of between lobes 48B and 48C and begin to upset into lobe 48C, as depicted in FIG. 7. The process continues to complete land 12C and progressively thereafter to form the central shaft portion 11 between the land 12C and lobe 48D and begin to upset into lobe 48D, as depicted in FIG. 8.

The process is completed as the metal upsets into the lobe 48D to form land 12D and then concludes with the formation of the actuating tang 16.

The formation of the spool valve element 10 beginning at the distal end 52 of the cavity 45 and proceeding progressively along the axial extent thereof, as described, precludes the drawbacks heretofore encountered, or anticipated, with press forging techniques to net form intricate shapes, and particularly shapes such as exemplified by the spool valve element 10, by virtue of press forging techniques.

When the aforesaid forging process is completed the removable block 33 may be removed from the anchored block 32 and the formed spool valve element 10 may be removed from the cavity 45. To assure the requisite hardness and sliding friction characteristic required for extended usage of the spool valve element it may be desirable to plate the formed metallic spool valve element 10. One highly suitable technique for assuring the requisite hardness and sliding friction characteristic of the valve element 10 is to employ an electroless nickel-boron plating to the forged surface of the element 10.

As should now be apparent, the present invention not only teaches that press forging techniques can be employed to net form intricate metallic shapes but also that the other objects of the invention can likewise be accomplished.

The embodiments of the invention in which an exclusive property or privilege is claimed are defined as follows:

1. A process for net forming metallic articles from cylindrical slugs, said articles having a distal end, a proximal end, and a plurality of cylindrical portions of predetermined diameters interconnected between the ends by a central shaft of less diameter than the predetermined diameters, said process comprising the steps of: providing a ram punch; providing a fixed die having a cavity with opposed ends, at least one end of the cavity being open and being disposed proximal to the ram punch, the second end of the cavity being located distal with respect to the ram punch, the cavity being contoured to the shape of the finished article to be net formed therein; providing a metallic slug made of a eutectic alloy; inserting the metallic slug within the cavity in the die; heating at least the die cavity to the recrystallization temperature of the eutectic alloy from which the slug is formed; driving the ram punch into the open end of the cavity to engage the end of the slug located closest to the open, proximal end of the cavity; and, press forming the slug into close conformity with the contours of the cavity, said forming being completed at the distal end of the cavity and thereafter being progressively completed toward the proximal end thereof.

2. A process for net forming metallic articles, as set forth in claim 1, comprising the additional steps of: heating the die and the metallic slug insertably received therein.

3. A process for net forming metallic articles, as set forth in claim 1, comprising the additional steps of: forming the slug from a zinc-aluminum alloy wherein the alloy comprises zinc falling substantially within the range of from about 75 percent to about 78 percent of the overall alloy and aluminum falling substantially within the range of from about 25 percent to about 22 percent.

4. A process for net forming metallic articles, as set forth in claim 3, comprising the additional steps of: including a trace of copper amounting to approximately 0.2 percent of the zinc-aluminum alloy.

5. A process for net forming metallic articles, as set forth in claim 4, comprising the additional steps of: driving the ram against the slug received within the die cavity at a force falling within the range of from about 8,000 pounds per square inch to approximately 14,000 pounds per square inch.

6. A process for net forming contoured metallic articles from cylindrical slugs, said articles having a distal end, a proximal end, and a plurality of surfaces intermediate said ends protruding outwardly from a central shaft, said process comprising the steps of: providing a slug of zinc-aluminum alloy; inserting the slug into a die having a cavity contoured to the shape of the finished article to be net formed therein, the cavity having an open end and a closed end, the cavity being aligned with a ram punch such that the open end is located proximal to the ram punch and the closed end is located distal to the ram punch; maintaining the cavity at or above the temperature of recrystallization; driving a ram punch into the open end of the cavity to complete forming the distal end of the article and thereafter progressively completing the article toward the proximal end; removing the article formed within the die; and, plating the formed article.

7. A process for net forming intricately contoured metallic articles, as set forth in claim 6, comprising the substitute step of: plating the article with a nickel-boron alloy.

8. A process for net forming intricately contoured metallic articles, as set forth in claim 6, comprising the substitute step of; effecting an electroless plating of the article formed by forging with a nickel- boron alloy.

* * * * *